United States Patent [19]

Lysenko et al.

[11] Patent Number: 4,624,759

[45] Date of Patent: Nov. 25, 1986

[54] ELECTROLYTIC METHOD FOR PRODUCING QUINONE METHIDES

[75] Inventors: Zenon Lysenko; Eric E. Bancroft, both of Midland, Mich.

[73] Assignee: The Dow Chemical Company, Midland, Mich.

[21] Appl. No.: 816,503

[22] Filed: Jan. 6, 1986

[51] Int. Cl.[4] ..... C07B 29/06; C07C 49/64

[52] U.S. Cl. ..... 204/78; 204/59 R; 204/72; 204/73 R; 204/74; 204/75

[58] Field of Search ..... 204/59 R, 72, 73, 74, 204/75, 78

[56] References Cited

U.S. PATENT DOCUMENTS

| | | | |
|---|---|---|---|
| 2,940,988 | 6/1960 | Coppinger | 260/396 |
| 3,102,124 | 8/1963 | Mitchell | 260/396 |
| 3,291,837 | 12/1966 | Goldberg et al. | 260/591 |
| 3,592,748 | 7/1971 | Wehry | 204/78 |
| 3,616,324 | 10/1971 | Covitz | 204/78 |
| 3,663,381 | 5/1972 | Covitz et al. | 204/78 |
| 3,758,391 | 9/1973 | Anderson et al. | 204/78 |
| 3,894,094 | 7/1975 | Rutledge | 260/620 |
| 3,897,319 | 7/1975 | Anderson et al. | 204/78 |
| 3,925,172 | 12/1975 | Voorhies | 204/74 |
| 3,937,741 | 2/1976 | Greco | 204/74 |
| 4,032,547 | 6/1977 | Bacha et al. | 260/396 N |
| 4,056,539 | 11/1977 | Greenwald | 260/326.14 N |
| 4,061,548 | 12/1977 | Jones et al. | 204/78 |
| 4,203,811 | 5/1980 | Cramer | 204/78 |
| 4,311,565 | 1/1982 | Bersier et al. | 204/737 |
| 4,394,227 | 7/1983 | Jäger et al. | 204/73 R |
| 4,464,236 | 8/1984 | Noding | 204/78 |
| 4,518,535 | 5/1985 | Naarmann et al. | 260/438.1 |
| 4,554,389 | 11/1985 | Shin et al. | 566/722 |

*Primary Examiner*—Arthur P. Demers

[57] ABSTRACT

A method for producing quinone methides by the electrolytic oxidation of bis(4-hydroxyphenyl)methanes at a potential of 1.1–1.5 V vs. SCE.

4 Claims, No Drawings

ELECTROLYTIC METHOD FOR PRODUCING QUINONE METHIDES

BACKGROUND OF THE INVENTION

The present invention relates to a method for the production of quinone methides, and more particularly, it relates to a method for electrolytically oxidizing bis(4-hydroxyphenyl)methanes to produce hydroxyphenyl quinone methides.

Quinone methides are known to be useful as antioxidants as taught by Coppinger U.S. Pat. No. 2,940,988. Coppinger discloses the oxidation of dihyroxydiphenyl methane with lead dioxide or lead tetraacetate to produce a free radical which is subsequently reduced to quinone methide. Reference is also made to Bacha U.S. Pat. No. 4,032,547 which discloses an oxidation process for preparing quinone alkides from the corresponding tri-alkyl or phenyl hindered phenols. The oxidizing agent of Bacha is ferricyanide as the secondary oxidant in combination with persulfate as the primary oxidant.

Quinone methides are also useful starting materials in the preparation of dihydroxybenzophenones, as disclosed in our copending application Ser. No. P16502 (Docket C-33,135). The dihydroxybenzophenones may, in turn, be used as light stabilizing agents and precursors for epoxy resins, polycarbonate resins, and other thermoplastics.

While prior art methods of preparing quinone methides exist, to date those methods have not found significant commercial utility because of their cost, inefficiencies, or other drawbacks.

Accordingly, the need exists for a process by which large quantities of quinone methides can be produced economically and at high yields.

SUMMARY OF THE INVENTION

In accordance with the present invention, there is provided a method for economically producing large amounts of quinone methides of the type

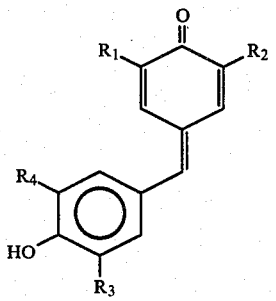

(I)

where $R_1$, $R_2$, $R_3$ and $R_4$ are either alike or different and are hydrogen, straight or branched chain alkyl moieties, cyclic alkyl compounds, halogen compounds, hydroxy and methoxy groups, and combinations thereof.

The instant method for preparing quinone methides of this type involves the oxidation of bis(4-hydroxyphenyl)methanes having the formula

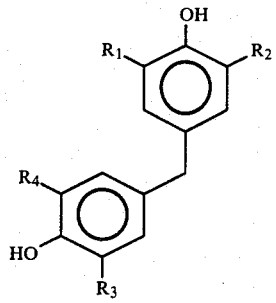

(II)

where $R_1$, $R_2$, $R_3$ and $R_4$ are as in formula (I).

The overall electrolytic reaction can be expressed as follows:

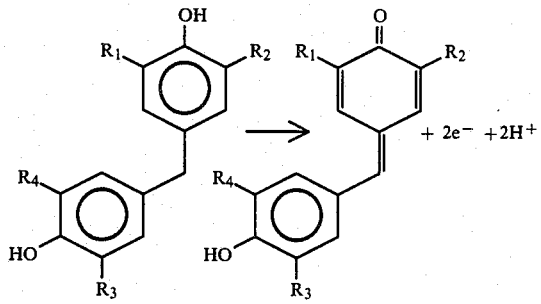

(II) (I)

The oxidation is conducted electrolytically using a platinum working anode for example. Other anode materials such as carbon or any other inert electrode material which remains stable at the oxidation potential may be used. The potential applied may vary between 1.1 V and 1.5 V vs. SCE and is preferably around 1.2 V vs. SCE. At potentials greater than about 1.5 V vs. SCE, oxidative cleavage is observed and p-benzoquinones and p-hydroxybenzaldehydes are produced. However, in the preferred range for oxidation potentials, essentially quantitative conversion of bis(4-hydroxyphenyl)methane to quinone methide is observed.

The result is an efficient, economical, high yield process for the production of the quinone methides of formula (I) which, as mentioned, find utility as antioxidants and starting materials for preparation of dihydroxybenzophenone precursors for the production of epoxy resins, polycarbonate resins, and other thermoplastics.

Accordingly, it is an object of the present invention to provide an inexpensive means to produce large quantities of quinone methides.

Other objects and advantages of the invention will become apparent from the following description and the accompanying claims.

DETAILED DESCRIPTION OF THE PREFERRED EMBODIMENTS

The preferred method is an electrolytic oxidation reaction carried out in an electrochemical cell at room temperature and pressure. A divided batch electrochemical cell is fitted with working and auxiliary electrodes and a suitable reference electrode such as a saturated calomel reference electrode (SCE). The cathode (auxiliary) compartment is filled with a supporting electrolyte solution. Any number of solvent/supporting electrolyte solutions can be used so long as they provide acceptable solubilities for bis(4-hydroxyphenyl)methanes and quinone methides. For example, acetonitrile and aqueous mixtures of acetonitrile containing up to 25% by volume acetic acid can be used as the solvents. Supporting electrolytes may include tetraethylammonium perchlorate, lithium perchlorate, and sodium acetate.

The working electrode is the anode, which may be platinum, carbon or any other inert electrode material which remains stable at the oxidation potential. The anode compartment is filled with the supporting electrolyte solution and the starting material. The required starting material is the substrate material. The working electrode is then biased to, and maintained at, a constant voltage vs. SCE using a three electrode potentiostat. During electrolysis, the anolyte solution is rapidly stirred using conventional stirring equipment.

The starting substrate material placed in the anode chamber is the bis(4-hydroxyphenyl)methane of formula (II). Bis(4-hydroxyphenyl)methanes of formula (II) where $R_1$, $R_2$, $R_3$ and $R_4$ are hydrogen, straight or branched chain alkyl moieties, cyclic alkyl compounds, halogen compounds, hydroxy or methoxy groups, or combinations thereof are available from Aldrich Chemical Company or Dow Chemical Company.

The starting material is dissolved in the supporting electrolyte solution in the anode compartment and stirred during application of a constant voltage vs. SCE of between 1.1 V and 1.5 V vs. SCE and preferably around 1.2 V vs. SCE. The electrolysis is allowed to come to equilibrium. This permits essentially complete conversion of the bis(4-hydroxyphenyl)methane starting material to quinone methide. The quinone methide may then be separated from the supporting electrolyte solution, and purified by recrystallizing from toluene.

The following example is illustrative.

EXAMPLE

This example illustrates the preparation of the quinone methide of bis(3,5-dimethyl-4-hydroxyphenyl)methane. A divided batch electrochemical cell as described was fitted with platinum working and auxiliary electrodes. The cathode (auxiliary) compartment was filled with an electrolyte solution which contained 0.25M sodium acetate in a mixture of one part by volume water, one part acetic acid, and three parts acetonitrile. The anode (working) compartment was filled with the same supporting electrolyte solution to which had been added 40 g bis(3,5-dimethyl-4-hydroxyphenyl)methane per liter of solution. The anode was then biased to, and maintained at, 1.20 V vs. SCE. For the duration of the electrolysis the anolyte solution was rapidly stirred using conventional mixing equipment. The electrolysis was continued to equilibrium (overnight), at which point the electrolysis current had decayed to a steady state background level. At that time the cell circuit was disconnected. Gas chromatographic analysis of the anolyte solution revealed essentially complete conversion of bis(3,5-dimethyl-4-hydroxyphenyl)methane to the corresponding quinone methide.

Additional runs were made in this system with solvent/supporting electrolytic solution containing acetonitrile, or aqueous mixtures of acetonitrile and up to 25% by volume acetic acid. Tetraethylammonium perchlorate or lithium perchlorate supporting electrolytes were also used in place of sodium acetate. These runs were conducted at room temperature and atmospheric pressure, with electrode potentials of 1.1–1.5 volts relative to the saturated calomel electrode (SCE). Essentially, quantitative conversion to the quinone methide was observed in each instance. However, as mentioned, at potentials greater than about 1.5 V vs. SCE oxidative cleavage took place.

While the methods herein described constitute preferred embodiments of the invention, it is to be understood that the invention is not limited to these precise methods and that changes may be made in the method without departing from the scope of the invention, which is defined in the appended claims.

What is claimed is:

1. A process for preparing quinone methides from bis(4-hydroxyphenyl)methanes comprising electrolytically oxidizing a bis(4-hydroxyphenyl)methane having the formula

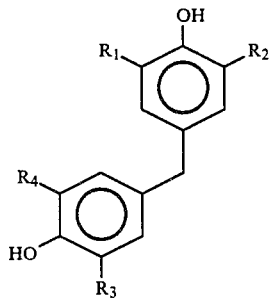

wherein $R_1$, $R_2$, $R_3$, and $R_4$ are either alike or different members selected form the group consisting of hydrogen, straight or branched chain alkyl moieties, cyclic alkyl compounds, halogen compounds, hydroxy and methoxy compounds, and combinations thereof in an anode compartment containing a supporting electrolyte solution and biased at a potential of 1.1 V–1.5 V vs. SCE to produce a quinone methide having the formula

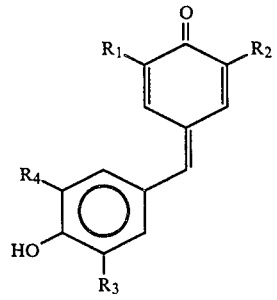

wherein $R_1$, $R_2$, $R_3$ and $R_4$ are as previously recited.

2. The process of claim 1 wherein said anode is a platinum anode.

3. The process of claim 1 wherein said oxidation takes place in the presence of a platinum anode at a constant voltage of 1.20 V vs. SCE and said reaction is carried out to equilibrium.

4. The process of claim 3 wherein said bis(4-hydroxyphenyl)methane is bis(3,5-dimethyl-4-hydroxyphenyl)methane.

* * * * *

UNITED STATES PATENT AND TRADEMARK OFFICE

CERTIFICATE OF CORRECTION

PATENT NO. : 4,624,759

DATED : November 25, 1986

INVENTOR(S) : Zenon Lysenko and Eric E. Bancroft

It is certified that error appears in the above-identified patent and that said Letters Patent is hereby corrected as shown below:

In column 1, line 15, please delete "dihyroxydiphenyl" and insert therefor "dihydroxydiphenyl".

In column 4, line 34, please delete "form" and insert therefor "from".

Signed and Sealed this

Eighteenth Day of August, 1987

*Attest:*

DONALD J. QUIGG

*Attesting Officer*

*Commissioner of Patents and Trademarks*